US005577333A

United States Patent [19]

Shick et al.

[11] Patent Number: 5,577,333

[45] Date of Patent: Nov. 26, 1996

[54] SOLID MEDIA PARTS DRYING USING FLUIDIZED BEDS

[75] Inventors: Reed A. Shick, Midland; Norman G. Moll, Sanford, both of Mich.

[73] Assignee: The Dow Chemical Company, Midland, Mich.

[21] Appl. No.: 360,533

[22] Filed: Dec. 21, 1994

[51] Int. Cl.[6] ..... F26B 3/08

[52] U.S. Cl. ..... 34/360; 34/371; 34/95

[58] Field of Search ..... 34/334, 345, 353, 34/354, 360, 367, 371, 95, 582

[56] References Cited

U.S. PATENT DOCUMENTS

| | | | |
|---|---|---|---|
| 1,154,167 | 9/1915 | Boland | 34/345 |
| 2,571,380 | 10/1951 | Penick | 252/417 |
| 2,684,124 | 7/1954 | Hines,Jr. | 183/4.2 |
| 3,623,233 | 11/1971 | Severinghaus | 34/9 |
| 3,755,915 | 9/1973 | Nagell | 34/95 |
| 3,968,571 | 7/1976 | Oschatz et al. | 34/95 |
| 4,002,488 | 1/1977 | Campanelli | 134/7 |
| 4,175,334 | 11/1979 | Gibert | 34/5 |
| 4,310,973 | 1/1982 | King | 34/10 |
| 4,617,282 | 10/1986 | van der Vleugel et al. | 502/66 |
| 5,016,304 | 5/1991 | Ryhiner | 34/95 |

OTHER PUBLICATIONS

"Solids Drying and Gas–Solid Systems", *Perry's Chemical Engineer's Handbook,* 6th ed. McGraw–Hill, (1984) pp. 20/74–20/75.

James, R. W., *Desiccants and Humectants,* New Jersey, Noyes Data Corp., 1973, p. 1, 168–169, 220–221. TP159.D7 J35.

*Primary Examiner*—F. Daniel Lopez

*Attorney, Agent, or Firm*—James T. Hoppe

[57] ABSTRACT

A method of drying articles is presented. The method generally comprises fluidizing solid media, contacting the article with the fluidized media for a sufficient amount of time to allow liquid to be transferred from the surface of the article to the solid media. Typically this involves forming a bed of solid material, fluidizing the bed then immersing the article to be dried in the fluidized bed. Using solid media to contact the wet parts, the water, and anything dissolved in it, is wicked away. The parts are dried in seconds with little residue and no heating. The solids used are typically porous and have very high surface area and can therefore be rapidly dried and reused.

16 Claims, No Drawings

SOLID MEDIA PARTS DRYING USING FLUIDIZED BEDS

This invention relates to drying articles using fluidized beds of solid media.

BACKGROUND OF THE INVENTION

Cleaning parts is an important step in many applications, either for functional or aesthetic reasons. The cleaning process usually consists of contacting the part with a cleaner in such a manner that the soil is removed from the surface of the part and then the soil-containing cleaner is replaced with clean liquid. The part is then dried. Traditionally organic solvents have been used due to their effectiveness in removing many common contaminants in production processes, as well as their ability to be easily removed from the part due to their typically high volatility. Recently, tighter environmental regulations have led many users to abandon traditional organic solvent-based cleaners in favor of aqueous cleaner systems. The use of aqueous cleaner systems heightens drying problems, however.

There are many conventional drying processes currently being used to dry parts that have been cleaned using aqueous systems. Each of these methods has weaknesses that make them less than ideal for many commercial uses. Some of these traditional drying processes include vaporization through thermal and/or vacuum means, displacement with a suitable volatile solvent, alcohol rinsing, centrifugal spinning, evaporation at ambient temperature often promoted by using flowing air streams, air knife displacement, and manually wiping off the parts with a towel.

In general vaporization techniques suffer from spotting because the liquid is removed as a vapor, leaving any dissolved solids or low volatility liquids behind. Furthermore, thermal vaporization is slow and very energy intensive. Vacuum aided drying is also slow and requires relatively expensive equipment. Additionally, these vaporization techniques frequently impose additional constraints on parts handling following drying. In thermal systems the part may be to hot to handle immediately upon drying, causing delays or requiring special handling techniques. Furthermore, some parts may become deformed or discolored at higher temperatures, making thermal drying systems inappropriate. In vaporization techniques without added heat, the part will cool due to evaporative cooling which may cause condensation of moisture from the ambient air on the part. Evaporative drying is slower and suffers from the same spotting problems mentioned above. Materials used in fluorinated solvent displacement or alcohol adsorption systems are often costly, flammable or toxic, making them unsuitable for many uses. These materials may also be restricted in use due to their being volatile organic compounds and/or ozone depleting materials. Towel drying is labor intensive, slow and does not work well on intricate parts. For a general review of current drying techniques and their associated problems, see Charles S. Leech, Jr., "Rinsing and Drying Issues and Answers", *Precision Cleaning*, Jan 1994, pp. 13–17.

An ideal drying system would incorporate the best features of all of these methods without any of the drawbacks. In other words, it would be fast, it would use relatively little energy, it would be resistant to spotting and it would not require the use of solvents. It is an object of the present invention to provide such a method of drying.

SUMMARY OF THE INVENTION

The present invention provides a new method for drying liquid from the surface of articles. The method generally comprises fluidizing solid media, contacting the article with the fluidized media for a sufficient amount of time to allow liquid to be transferred from the surface of the article to the solid media. Typically this involves forming a bed of solid material, fluidizing the bed then immersing the article to be dried in the fluidized bed. Using solid media to contact the wet parts, the water, and anything dissolved in it, is wicked away. The parts are dried in seconds with little residue and no heating. The solids used are typically porous and have very high surface area and can therefore be rapidly dried and reused.

Additional advantages and features of the present invention will become apparent from a reading of the detailed description of the invention.

DESCRIPTION OF THE INVENTION

The invention is a method and apparatus for drying parts which is efficient, fast, and results in little or no spotting. The method comprises fluidizing a bed of solid media, then contacting the part to be dried with the fluidized bed.

The present invention is suitable for any part or article which has a need to have a liquid removed from its surface. Although it is anticipated that the present invention will have its greatest utility in the removal of water, "liquid" includes any substance located on the surface of the part which is in liquid form. The part to be dried and the particular type of liquid to be removed will dictate the material to be used as the solid drying media.

Both adsorbent and absorbent materials can be used with the present invention. For the purposes of this invention, a material is "absorbent" if the liquid fills the pores of the material as a bulk phase, whereas the material is considered to be "adsorbent" if the liquid adheres to the surface of the material in a thin layer. Because absorbent materials are generally more efficient in picking up liquid they are generally preferred.

Rate of pick up for the liquid is a primary characteristic to consider when selecting the solid drying media. A material will generally have a fast rate of pick up if it is of moderate to high porosity so that there is a large amount of surface area to which the liquid can adhere. The surface of the absorbent should be readily wet by the liquid to be removed. Also the solid drying material should not be easily crushed, should resist dusting during use, and should be able to be readily dried and regenerated. The material chosen should also ideally retain its mechanical properties when saturated with the liquid to be removed, so that the fluid bed may be operated at moderately high liquid content. Furthermore, the solid drying material should not be harder than the part to be dried if scratching of the part is a concern. It is also preferred that the solids be static dissipative. Finally, so that the solid media can be easily and efficiently fluidized, it should be free flowing, such that it could be poured.

Potential drying media for the removal of water include hydrophilic porous solids, hydrophilic porous polymer solids, hydrophilic open cell foams, water swellable polymers, and some natural absorbent materials. Hydrophilic porous solids include materials such as molecular sieves, activated alumina, silica gel and porous silica beads. Hydrophilic porous polymeric solids include materials such as ion exchange resin. Hydrophilic open cell foams include materials such as polyurethanes. These preferably flexible foams can be prepared by treating hydrophobic foams with one or more surfactants, as is known in the art (see, for example, M. J. Rosen, *Surfactants and Interfacial Phenomena*, 2nd ed., Wiley & Sons, New York (1989) pp. 240–247). Water swellable polymers include materials such as DRYTECH™ Shar-Pei super absorbent polymers and certain ion exchange gels. Combinations of two or more different materials could also be advantageously used with this invention. Natural absorbent materials include materials such as ground corn cobs, saw dust, or particles of natural sponges.

The size and shape of the solid adsorbent or absorbent material depends largely on the configuration of the part to be dried and the system used to contain and fluidize the bed. The initial requirement for the particles is that they must be capable of being fluidized.

Fluidization of solid drying material is preferably accomplished by flowing gas upwards through a bed of the material, but other methods such as vibrational or mechanical means could be used. Particles may also be thrown at the parts to be dried as in a shot blasting operation. It is even possible to fluidize the solid media by pouring the particles onto the part to be dried. Fluidization of the solid material occurs when individual particles of the material are free to move among similar particles in a manner comparable to the way in which individual molecules of a liquid are free to move within the liquid. Gas fluidization depends in part on the velocity of the gas which is being used to fluidize the bed, the dimensions including depth of the bed, and the size, shape and density of the particles to be fluidized. The gas should flow through the bed of solid material at a sufficient rate such that the bed is partially supported by the gaseous flow, thus allowing the particles to move like a fluid. The type of gas used to fluidize the bed depends largely on cost and availability, but it should be inert towards the liquid, the solid media and the part to be dried. Air or inert gases such as $N_2$ or $CO_2$ can be used for the removal of water, with air being the most preferred as it eliminates any possibility of asphyxiation. For a more detailed description on fluidization of solid beds, see D. L. Keairms et al., *Fluidized Bed Fundamentals and Applications*, AIChE Symposium Series, Am. Inst. of Chem. Eng., New York, N.Y. (1973); J. G. Yates, *Fundamentals of Fluidized-Bed Chemical Processes*, Butterworths, London (1983); or A. W. Weimer, *Fluidized Processes: Theory and Practice*, AIChE Symposium Series, Am, Inst. of Chem. Eng., New York, N.Y. (1991); each of which is herein incorporated by reference.

Thus, the size and shape of the solid adsorbent or absorbent material chosen must be capable of being fluidized given the bed size and the limitations of the rate of gas flow or other fluidizing means available, Among the fluidizable shapes, it is generally preferred to use particles which are spherical or near spherical in shape, since solids with flat or broken surfaces tend to stick to the wet part by capillary action, especially when the flat surface of the particle comes into contact with the flat surface of the part, Sphere-like particles offer relatively small areas where the particle can come in contact with the part thereby decreasing the amount of force generated by the capillary action, Parts with small holes or crevices tend to be especially difficult to dry because the liquid can become trapped in the holes or crevices, preventing contact with the solid media. This is especially true if the particles are fairly large. On the other hand, small particles are more susceptible to sticking to the part due to capillary action, resulting in a dramatic decrease in the rate of drying. This problem is heightened when the size of the crevice or hole is close to that of the solid particles. Drying of parts with small holes or crevices would be aided by the use of particles having a bulky core with spines protruding from the core in all directions. The small diameter of the spines would allow them to remove water from the crevices and blind holes, while the preferably spherical core would give the particle the size necessary to help prevent the particle from sticking to the part. The shape and size of the core and the length and diameter of the spines could be optimized for the particular part to be dried. Particles of this type could be molded from a hydrophilic flexible open celled foam. To ensure adequate strength the cell size of the foam should be very small and the foam should be of relatively high density.

It is preferred that the bed of solid material be fluidized using gas that is not saturated with the liquid to be removed, so that as the gas fluidizes the bed it can simultaneously remove by evaporation any liquid which the solid material may have removed from a part. Similarly, it may be beneficial to heat the gas so that it may more readily remove the liquid from the solid media. Using heated gas could also be beneficial in compensating for any evaporative cooling which may occur. Thus, when gas-fluidizing the bed, the solid media can remove liquid from the part through absorbency or adsorbency while the gas simultaneously removes the liquid from the solid media through evaporation. Such a system would eliminate any down time needed to regenerate the solid media.

It is also possible to dry the part and the media in separate steps. A two step scheme may be advantageous in regards to energy consumption, particularly if the solid media used is capable of being squeezed without being irreversibly transformed such that the absorbed liquid could be forced out. In such a situation the solid media could be fluidized using mechanical or vibrational means or simply be poured onto the part to be dried. When the media becomes partially or totally saturated with the liquid the media could be removed and regenerated by squeezing the liquid out of the media. The solid media would then be ready for drying another part. This process would require less energy than when the liquid is removed from the media by evaporation.

The invention will become more clearly understood by considering the following examples.

EXAMPLE 1

A fluidized bed was set up consisting of a 40 mm diameter by 160 mm high column equipped with a coarse glass frit at its lower end. Various solid media summarized in Table 1 were placed in the tube to a depth of 50 mm. Fluidization of the absorbent or adsorbent solids was achieved by passing dry nitrogen upwards through the frit and the column at a rate clearly in excess of the rate necessary to fluidize the solids. Steel coupons, 48×14×0.5 mm were dipped in water then submerged in the fluidized media for drying. The time required for the disappearance of all visible water from the coupon surfaces is noted in Table 1 for various solid media as well as for nitrogen in the absence of solid adsorbent or absorbent material for comparison. The Molecular Sieves used were all type A silica aluminate zeolite, 4 angstrom pore size. The Shar-Pei polymer particles were of convoluted shape approximately 1 mm in diameter. The ion exchange resin particles were generally spherical about 800 μm in diameter.

TABLE 1

| Media | Drying Time |
|---|---|
| Molecular Sieves 4–8 mesh | 3 seconds |
| Molecular Sieves 8–12 mesh | 5 seconds |
| Molecular Sieves 10–16 mesh | 7 seconds |

TABLE 1-continued

| Media | Drying Time |
|---|---|
| Shar-Pei super adsorbent polymer | 15 seconds |
| Ion exchange resin (with low absorbency) | 20 seconds |
| Dry nitrogen, no solid | 1200 seconds |

EXAMPLE 2

In typical drying processes where water is evaporated from a solid surface, spotting occurs due to the small amounts of non-volatile residue being deposited at the point were the last water remains before evaporation. Since the soil deposited by the evaporation process frequently includes ionic materials which conduct electricity, the presence of water spots on sensitive electronic components is unacceptable. In the present invention the water is removed from the surface as a liquid and thus takes with it the dissolved materials. To demonstrate the effectiveness of the present invention in removing the dissolved materials the following tests were run. Soluble dye was added to the water in which the coupon was dipped in Example 1. After drying as in Example 1, the part was rinsed and the rinse water was collected. Colorimetric measurements of the original solution were used to determine how much dye initially was on the part and how much dye was recovered in the rinse. Table 2 presents the fraction of dye remaining on the part after drying versus the amount on the initially wet part, which is presumably the amount which would be left upon drying the part using only a stream of gas with no solid media.

TABLE 2

| Media | Residue |
|---|---|
| Molecular Sieves 4–8 mesh | 0.0176 |
| Molecular Sieves 8–12 mesh | 0.0156 |
| Molecular Sieves 10–16 mesh | 0.0124 |
| Shar-Pei | 0.0358 |

It should be realized by one of ordinary skill in the art that the invention is not limited to the exact configuration or methods illustrated above, but that various changes and modifications may be made without departing from the spirit and scope of the invention as described within the following claims.

What is claimed is:

1. A method of removing liquid and materials dissolved or suspended in the liquid from a surface of an article comprising:

(a) fluidizing a bed of solid absorbent media;

(b) contacting the article with the fluidized media for a sufficient amount of time to allow liquid and at least a portion of any materials dissolved or suspended in the liquid to be transferred from the surface of the article to the solid media.

2. The method of claim 1 wherein the solid media is arranged in a bed and wherein the bed is fluidized by flowing a stream of gas upwards through the bed.

3. The method of claim 2 wherein the gas is heated prior to fluidizing the bed.

4. The method of claim 1 wherein the liquid being removed is water.

5. The method of claim 4 wherein the solid media comprises one or more materials selected from a group consisting of water swellable polymers, hydrophilic porous polymeric solids, hydrophilic open cell foams, hydrophilic porous solids, and natural absorbent materials.

6. The method of claim 5 wherein the solid media comprises alumina.

7. The method of claim 5 wherein the solid media comprises porous silica.

8. The method of claim 5 wherein the solid media comprises polyurethane particles.

9. The method of claim 1 further comprising (c) removing the liquid from the solid media so that the media may be used to remove liquid from another article.

10. The method of claim 9 wherein gas is used to fluidize the bed and wherein the gas is not saturated with the liquid to be removed such that the liquid can be evaporated from the media at the same time as the liquid is being transferred from the article to the media.

11. The method of claim 10 wherein the gas is heated prior to fluidizing the bed.

12. The method of claim 9 wherein the solid media is a flexible material and the liquid is removed from the media by squeezing the liquid out of the media.

13. The method of claim 12 wherein the solid media comprises polyurethane particles.

14. The method of claim 1 wherein the solid media comprises generally spherical shaped particles.

15. The method of claim 1 wherein the solid media includes particles having a core with spines extending from the core.

16. The method of claim 15 wherein the particles are formed from a hydrophilic open cell foam.

* * * * *